US007547125B2

(12) United States Patent
Burt et al.

(10) Patent No.: US 7,547,125 B2
(45) Date of Patent: Jun. 16, 2009

(54) GUARD DEVICE FOR A LIGHT SOURCE

(75) Inventors: Harvey F. Burt, Minneapolis, MN (US); Jason L. Klassen, St. Louis Park, MN (US); Eric E. Sly, Cologne, MN (US)

(73) Assignee: General Dynamics Advanced Information Systems, Inc., Fairfax, VA (US)

( * ) Notice: Subject to any disclaimer, the term of this patent is extended or adjusted under 35 U.S.C. 154(b) by 437 days.

(21) Appl. No.: 10/986,453

(22) Filed: Nov. 12, 2004

(65) Prior Publication Data

US 2005/0195611 A1 Sep. 8, 2005

Related U.S. Application Data

(60) Provisional application No. 60/519,367, filed on Nov. 12, 2003, provisional application No. 60/519,344, filed on Nov. 12, 2003, provisional application No. 60/519,470, filed on Nov. 12, 2003.

(51) Int. Cl.
*F21V 15/00* (2006.01)

(52) U.S. Cl. ..... 362/376; 362/253; 362/297; 362/344

(58) Field of Classification Search ..... 362/376, 362/377, 256, 378, 344, 353, 298–305, 297
See application file for complete search history.

(56) References Cited

U.S. PATENT DOCUMENTS 3,652,845 A * 3/1972 Thomas ..... 362/378
4,213,171 A * 7/1980 Sassmannshausen ..... 362/310
4,928,214 A * 5/1990 Oyama ..... 362/518
4,953,063 A * 8/1990 Nino ..... 362/539
4,954,938 A * 9/1990 Lyons ..... 362/298
5,390,095 A * 2/1995 Lemons et al. ..... 362/301
5,416,683 A * 5/1995 McCarthy ..... 362/328
5,448,462 A * 9/1995 Moran, III ..... 362/301
6,318,886 B1 * 11/2001 Stopa et al. ..... 362/555
6,341,885 B1 * 1/2002 Futami et al. ..... 362/518
6,343,872 B1 * 2/2002 Cerone et al. ..... 362/297
7,080,924 B2 * 7/2006 Tseng et al. ..... 362/241
7,261,440 B2 * 8/2007 Kwasny ..... 362/297

* cited by examiner

*Primary Examiner*—Sandra L. O'Shea
*Assistant Examiner*—Gunyoung T. Lee
(74) *Attorney, Agent, or Firm*—Steptoe & Johnson LLP

(57) ABSTRACT

An embodiment of the present invention relates to the protection of electronic displays and includes a guard configured to protect a lighting means while providing an expanded field of view. The guard may include a first element and a second element each having at least a top surface and a wall. The lighting means may be positionable substantially between the first element and the second element such that the top surface of the lighting means is below the first top surface and the second top surface to protect the lighting means from incidental impact. A gap between the first and second elements provides a field of view. The field of view may include a substantially orthogonal line of sight to one side surface of the lighting means.

11 Claims, 8 Drawing Sheets

GUARD DEVICE FOR A LIGHT SOURCE

CROSS REFERENCE TO RELATED APPLICATIONS

This application is a non-provisional application under 35 U.S.C. § 119(e) and hereby claims priority to U.S. Provisional Application Nos. 60/519,367, 60/519,344, and 60/519,470, each of which was filed on Nov. 12, 2003, and each of which are hereby incorporated by reference in their entirety.

BACKGROUND OF THE INVENTION

The present invention generally relates to electronic displays and more particularly, to the protection of displays with high visibility requirements.

The expansion of electronics into practically every aspect of modem life has expanded the use of light emitting diodes (LEDs) and other displays, which are extensively used in modem electronics. As typically used in electrons, LEDs display simple information indicative of status or operation. For example, LEDs are used as power lights indicating whether electricity is supplied to an electronic device such as a computer or television. LEDs are also used to indicate the operation of an electronic device. Television remotes typically include LEDs that flash or light up as a signal is transmitted to the television or as the channel is changed. Likewise, electronic voltage detectors activate a LED in the presence of a threshold voltage.

Faced with the need to provide a visible field of view, electronic devices struggle to position LEDs in highly visible location. One approach includes allowing LEDs to protrude from the electronic device housing to increase visibility and field of view. For a given electronic device, the field of view of the LED includes all angles from which the LED is within the expected direct line of sight of a user. As a result of basic geometry, the further an LED protrudes from a device housing, the greater the field of view of the LED.

Unfortunately, while an electronic device housing protects the internal electronics, protruding LEDs are left susceptible to incidental impacts during use and damage if dropped. In some applications, incidental impacts significantly reduce the reliability and robustness of the electronic device due to the nature of their operation. For example, handheld electronic devices, such as television remotes and handheld voltage detectors, require higher reliability and robustness during operation due to the character of their use. As handheld devices are often dropped or knocked against other objects, protruding LEDs on voltage detectors are especially susceptible to damage during use.

In many harsh or strenuous working environments, handheld electronic devices are often dropped or fall from uneven surfaces. For example, in many military environments, testing electronic voltages across terminals on vehicles, aircraft, and weapons requires workman to manipulate handheld voltage detectors in tight areas where there are few stable flat surfaces to place the electronic voltage detector. In these types of situations, the LEDs in the electronic devices are often damages by contact with other equipment or by accidentally dropping the electronic device.

Increased visibility and hence protruding LEDs are sometimes necessary in some applications involving tight working areas with difficult lighting conditions. Unfortunately, the replacement and maintenance of damaged LEDs adds additional costs. More particularly, replacement of individual LEDs is difficult due to their size and electrical connections, resulting in increase down time and inefficiency. Alternatively, replacement of electronics or entire electronic devices is impractical and costly. In these situations, the LEDs may also be individually expensive to replace because cheaper less rugged lighting elements or cheaper LEDs are unavailable to be used on the exterior of the electronic devices.

To protect LEDs from incidental impact and reduced reliability, electronic devises embed LEDs within the housing. While, surrounding the LED with the housing may allow potential impacts to the LED to be deflected by the housing, the embedded LEDs inherently possess a reduced field of view and fail to remain visible unless a user is directly over the LED. In tight working conditions, a user may be unable to maintain direct line of sight to an LED while positioning the electronic device, rendering the device inefficient, if not useless.

What is needed is an LED protector that protects the LED from impacts yet provides an increased, wider field of view. Additionally, what is needed is an LED display that is protected from incidental impact yet still visible from extended angles during use. While some goals of the present invention have been mentioned, this is not meant to be limiting on the present invention. Any of these exemplary characteristics of systems of the present invention may include any one or more of these aforementioned characteristics.

SUMMARY OF THE INVENTION

Thus, the present invention seeks to address at least some of the foregoing problems identified in prior art systems.

An embodiment of the present invention may includes a guard configured to protect a lighting means. The lighting means may include a top surface and at least one side surface. The guard may include a first element and a second element. The first element may have a top surface and a first wall and the second element may have a top surface and a second wall, which is angularly disposed to the first wall. The lighting means may be positionable substantially between the first element and the second element such that the top surface of the lighting means is below the first top surface and the second top surface. The first element and the second element may substantially define a first gap which provides a first field of view. The first field of view may include at least one first substantially orthogonal line of sight to the at least one side surface of the lighting means.

Another embodiment of the present invention includes a housing for an electronic device configured to protect a lighting means. The housing may include a body portion and a guard as described above. The guard may be a separate device attached to the body or may be integrally formed with the housing. The guard may also be positioned on a corner of the body of the housing.

BRIEF DESCRIPTION OF THE DRAWINGS

While the specification concludes with claims particularly pointing out and distinctly claiming the present invention, it is believed the same will be better understood from the following description taken in conjunction with the accompanying drawings, which illustrate, in a non-limiting fashion, the best mode presently contemplated for carrying out the present invention, and in which like reference numerals designate like parts throughout the Figures, wherein:

DETAILED DESCRIPTION OF THE INVENTION

The present disclosure will now be described more fully with reference the to the Figures in which various embodiments of the present invention are shown. The subject matter of this disclosure may, however, be embodied in many different forms and should not be construed as being limited to the embodiments set forth herein.

Figure 1:
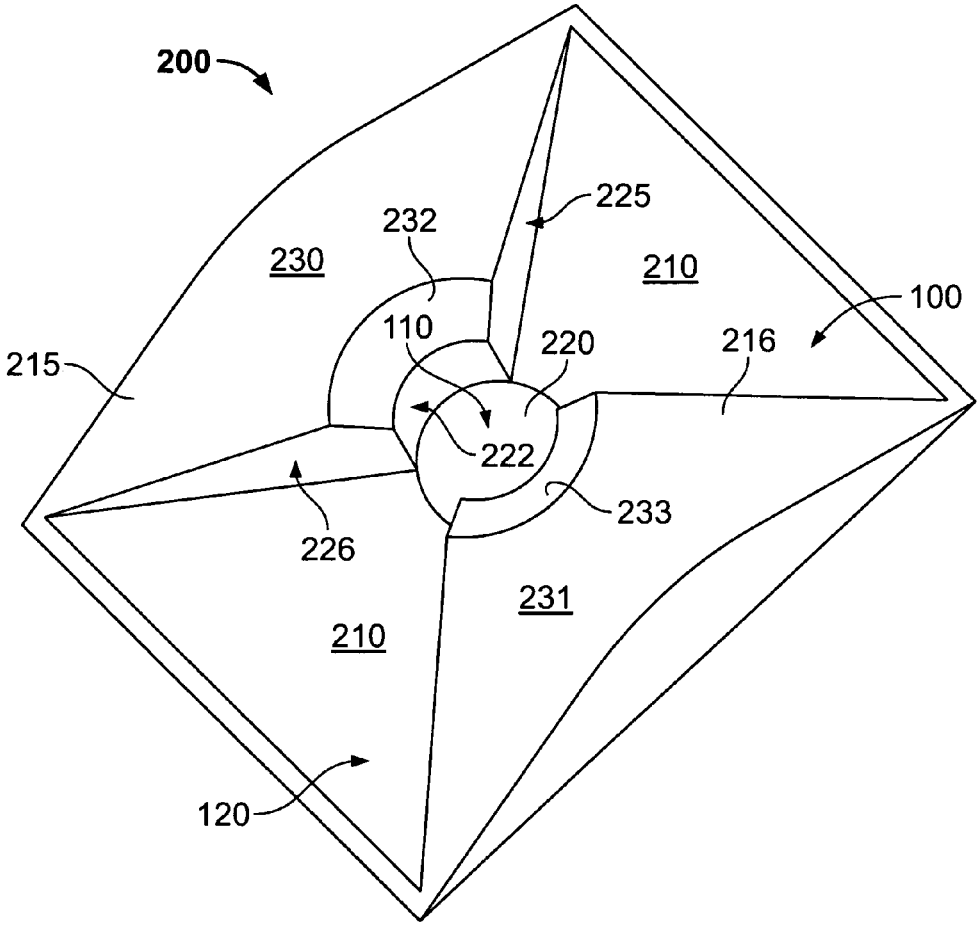
FIG. 1 shows a perspective view of an LED guard according to an embodiment of the present invention.

FIG. 1 shows a perspective view of an LED guard 200 used to protect an LED from being damaged by contact with other objects. The guard 200 includes a base 210 with an opening 220. Within opening 220, an LED (not shown in FIG. 1) may be positioned within the guard 200 such that the LED is protected from incidental impact. In the embodiment shown in FIG. 1, the elements 215 and 216 form protective ridges or volumes to deflect contact with the LED 250 while defining gaps 100, 110, and 120, which provide fields of view to the LED 250.

The element 215 includes walls 222, 225, and 226. The element 215 also includes a top surface 230 and a beveled edge 232 between the top surface 230 and the walls 222, 225, and 226. Likewise, the element 216 includes walls 223, 227, and 228 (shown in FIG. 2). The element 216 also include a top surface 231 and a beveled edge 233 between the top surface 231 and the walls 223, 227, and 228. The walls 225 and 228 generally define the outer edges of the gap 100, which provides a field of view from the right side of FIG. 1 to an LED in the guard 200. The walls 222 and 223 generally define the outer edges of the gap 110, which provides a field of view from above to an LED in the guard 200. Finally, the walls 226 and 227 define the outer edges of the gap 120, which provides a field of view from the left side of FIG. 1 to an LED in the guard 200.

Figure 2:
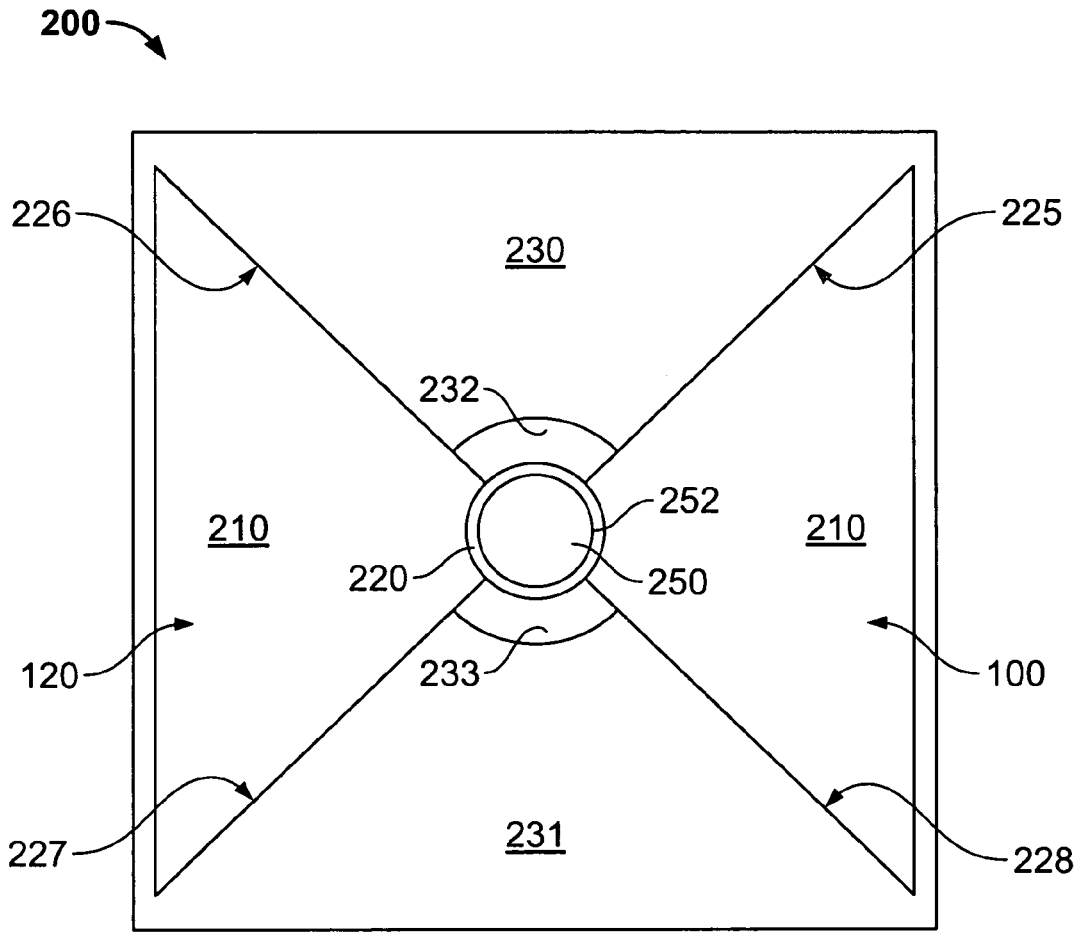
FIG. 2 shows a top plan view of an LED guard according to an embodiment of the present invention.

FIG. 2 shows a top plan view of the guard 200 with the LED 250 protruding through the opening 220. As seen in the figure, the LED 250 is positioned between the elements 215 and 216 and in the gap 110 such that a small clearance is visible between the LED 250 and the walls 222 and 223. The walls 222 and 223 are shown in FIG. 2 as substantially conforming and curving around the LED 250. The shape and positioning of the walls 222 and 223 allow the elements 215 and 216 to substantial protect the LED 250 from impacts with other objects by maintaining a clearance with the LED 250. The clearance reduces transference of any force that impacts the guard 200. Sufficient clearance is maintained to reduce the possibility of an object falling between the elements 215 and 216.

As seen in FIG. 2, any potential damage to the LED 250 may only result from a direct impact from above the guard 200. The gap 110 acts as a gateway to the LED 250, allowing the guard 200 to deflect incidental impact. The gap 110 is sized to provide a sufficient opening such that the LED 250 is clearly visible from above while being sizes sufficiently small enough to protect against large and potentially damaging objects from falling within the gap 110. As discussed below, the beveled edges 232 and 233 provide additional visibility to the LED 250 while only minimally exposing the LED 250 to potential impact.

Although the walls 222 and 223 are shown in FIG. 2 as curved and conforming to the LED 250, the walls 222 and 223 could be straight or otherwise shaped so long as their proximity to the LED 250 provides protection against impacts with other objects. The clearance may also be reduced such that the walls 222 and 223 actually contact the LED 250 or increased to provide additional space between the LED 250 and the walls 222 and 223 without deviating from the scope and spirit of the present invention.

As shown in FIGS. 1 and 2, the walls 225 and 228 and walls 226 and 227 are generally symmetrical and angularly disposed at ninety degrees. It should be obvious to one skilled in the art that the gaps 100 and 120, formed by the walls 225, 226, 227, and 228, may be different sizes. Furthermore, the gaps 100 and 120 need not be equal in size, symmetric, or opposite each other. The gaps may also be directed in particular directions to point toward a user or cast light on special instruments without deviating from the scope and spirit of the present invention.

Although not shown presently in the figures, it is also contemplated that additional elements could be added to the elements 215 and 216 such that three or more gaps would be present. It is also possible that only one gap may be required in some usages such that elements 215 and 216 could be combined with only one gap formed from two walls, such as 226 and 227.

Figure 3:
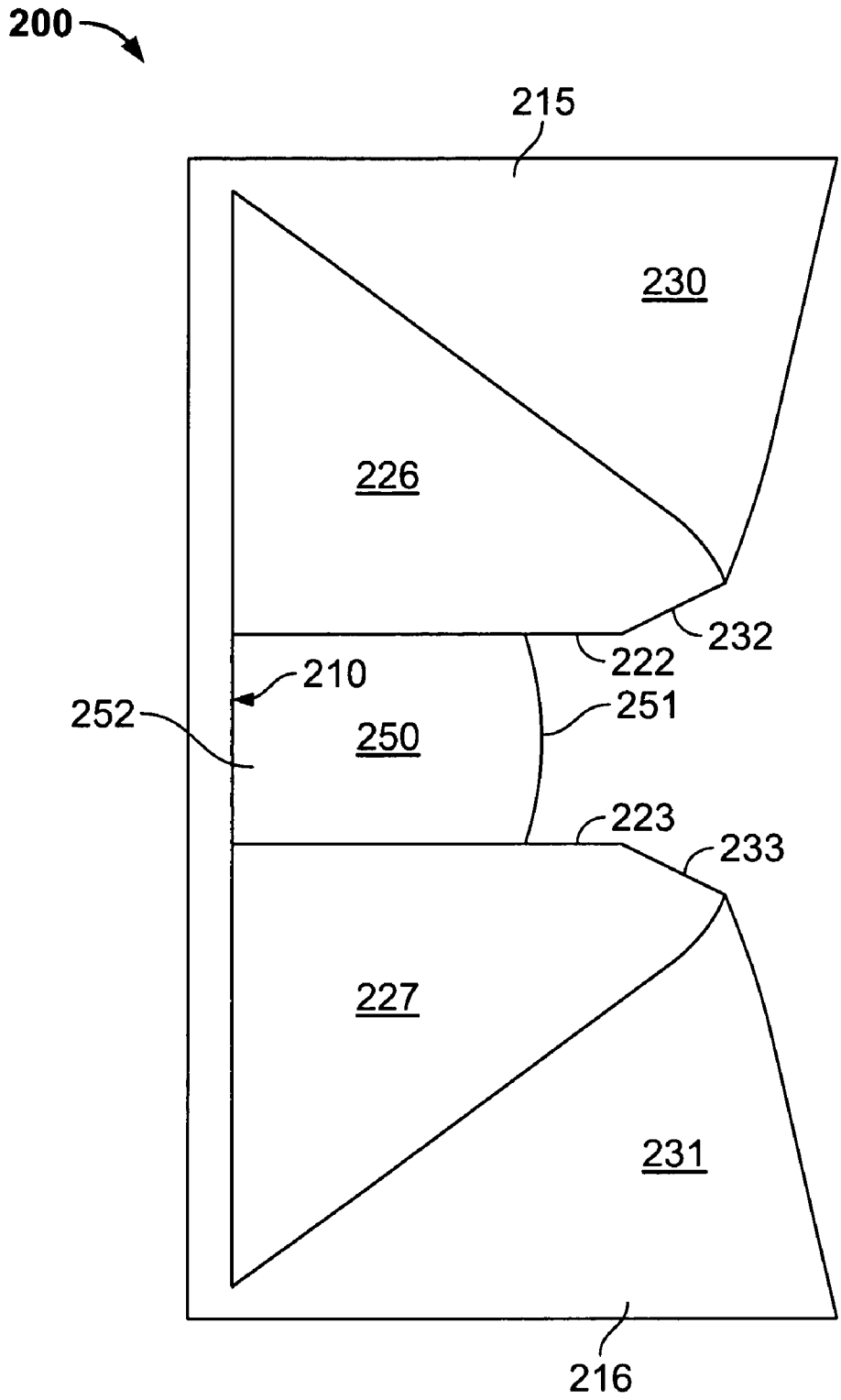
FIG. 3 shows a side view of an LED guard according to an embodiment of the present invention.

FIG. 3 shows a side view of the guard 200 and the LED 250. As shown, FIG. 1 provides a direct line of sight into the gap 120 and a substantially orthogonal line of sight to the side surface 152 of the LED 250. The top surface 251 of the LED 250 is shown within the gap 110 and below the surfaces 230 and 231. The LED 250 is also positioned below the intersection between the wall 222 and the beveled edge 232. It should be noted however that the LED 250 may be positioned at various locations within the gap 110 so long as the top surface 251 of the LED 250 is below the top surface 230 and the top surface 231. As mentioned above, the LED 250, as shown positioned within the gap 110, is protected from impacts with objects directed from the right side of FIG. 3 unless the objects are smaller than the opening of the gap 110.

As shown in FIG. 3, the guard 200 provides a clear field of view of the side of the LED 250 through the gap 120. The gap 100 provides a field of view that is symmetric to the field of view for the gap 120 as shown in FIG. 3. While embedded LEDs are traditionally only visible when viewed from above, the guard 200 provides visibility from the sides of the LED 250 only previously available by protruding the LED beyond the top surfaces 230 and 231.

The guard 200 provides visibility from the side while also protecting the LED 250 from impacts with objects directed into the gap 120. Unless an object is small enough to fit within the smallest opening of gap 120 between the walls 226 and 227, the object is deflected away from the LED 250 by the guard 200. It should be noted that the size and shape of the elements 215 and 216 also provide structural strength and rigidity to deflect objects and absorb impacts without transferring destructive forces to the LED 250.

The walls 222, 223, 225, 226, 227, and 228 are shown as perpendicular to the base 210 and parallel to the side surface 152 of the LED 250. However, it should be noted that, in alternative embodiments, the width of the gaps and the angles of the walls 222, 223, 225, 226, 227, and 228 may be altered without deviating from the scope and spirit of the present invention. The base 210 may also be modified to allow the base 210 to angle upward toward the LED 250 or otherwise in other contemplated embodiments.

Figure 4:
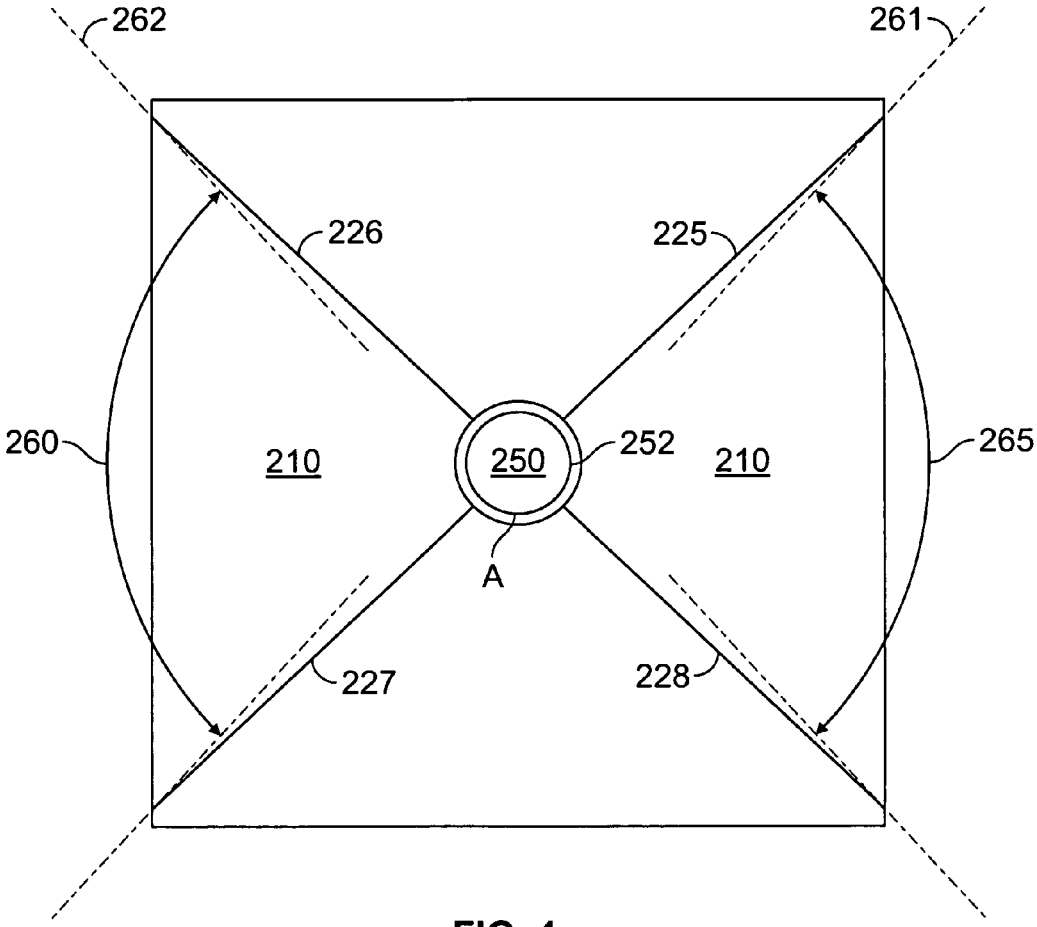
FIG. 4 shows a cross-sectional view of an LED guard according to an embodiment of the present invention.

FIG. 4 shows a cross-sectional view of the guard 200 and the LED 250 along the base 210. As shown, the LED 250 is centered in the opening 220 with the walls 225, 226, 227, and 228 geometrically defining the fields of view to the LED 250. Although the walls 225 and 228 are shown angularly disposed ninety degrees apart, the field of view 265 is slightly larger than ninety degrees. This is due to the fact that the line of sight 261 is capable of entering the gap 100 along the wall 225 and still see the opposite side surface of the LED 250 at the location A. The field of view 265 therefore describes, in two dimensions, how a user along a line of sight anywhere within the gap 100 and the field of view 265 may view the LED 250. Likewise, the field of view 260 defines, in two dimensions, how a user along a line of sight anywhere within the gap 120 and the field of view 260 may view the LED 250.

It should be obvious to one skilled in the art that the angular disposition of the walls 225, 226, 227, and 228 may be modified to adjust the fields of view 260 and 265. The walls may be adjusted to increase or decrease the size of the fields of view and may also be modified such that one field of view is large or smaller than the other. Furthermore, the fields of view 260 and 265 are shown oppositely disposed. However the walls 225, 226, 227, and 228 may be configured such that the fields of view 260 and 265 are positioned asymmetrically and at different angles to direct light in specific directions without deviating from the scope and spirit of the present invention.

Figure 5:
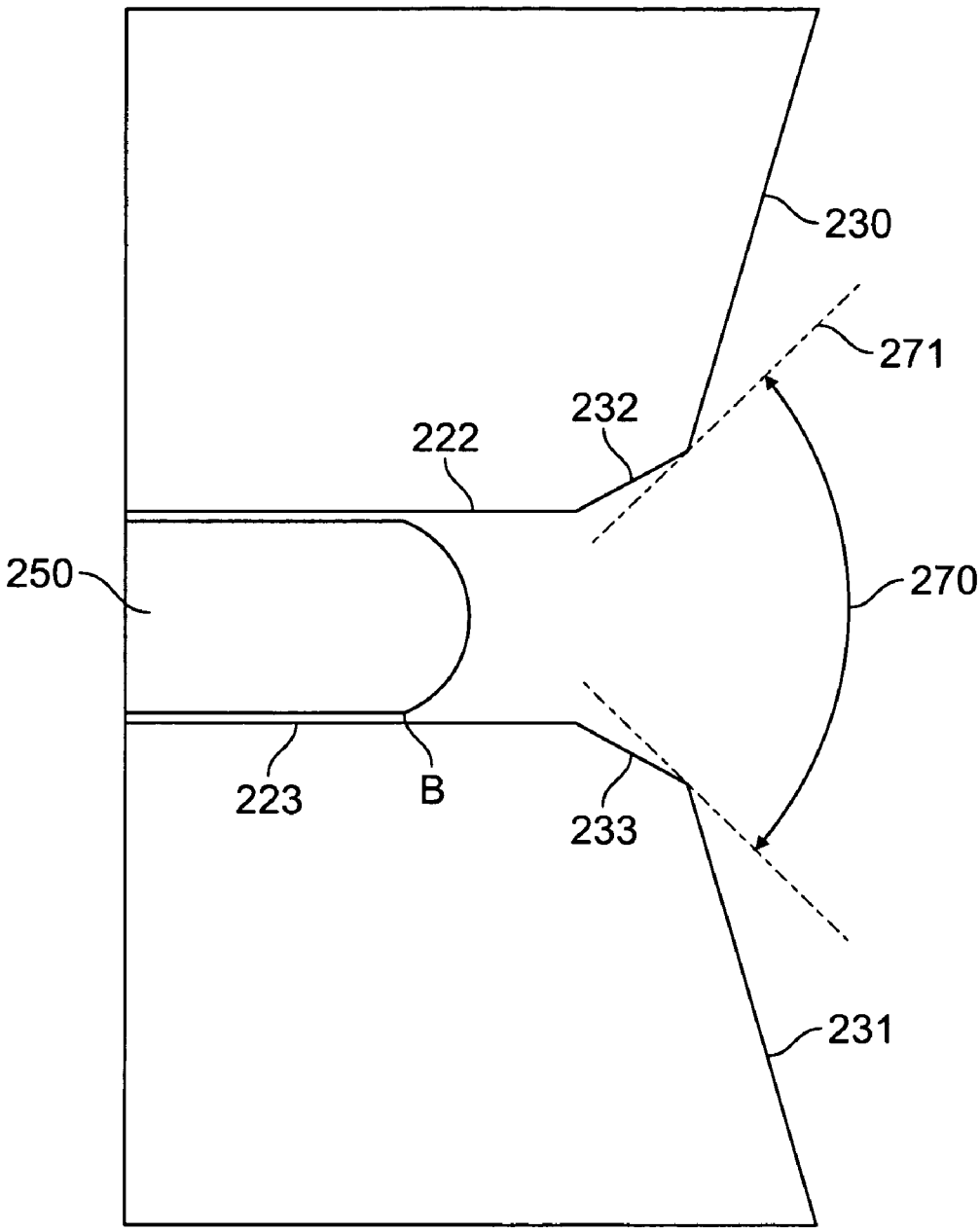
FIG. 5 shows another cross-sectional view of an LED guard according to an embodiment of the present invention.

FIG. 5 shows a cross-sectional view of the guard 200 and the LED 250 through the center of the LED 250 and the center of the elements 215 and 216. FIG. 5 demonstrates the field of view 270. As in the discussion of the field of view 265, the field of view 270, in two dimensions, is greater than the angular disposition between the beveled edges 232 and 233. The line of sight 271 passes into the gap 110 and hits the outer edge of the LED 250 at location B. As such, a direct line of sight to the LED 250 is possible anywhere within the field of view 270. It should be obvious to one skilled in the art that increasing or decreasing the angle or position of the beveled edges 232 and 233 or the walls 222 and 223 may modify the field of view 270.

Although the fields of view 260, 265, and 270 have been discussed with reference to two dimensions in FIGS. 4 and 5, it should be obvious to one skilled in the art that the full field of view of the LED 250 provided by the guard 200 is a three-dimensional construct and may be easily determined by geometrical analysis.

Figure 6:
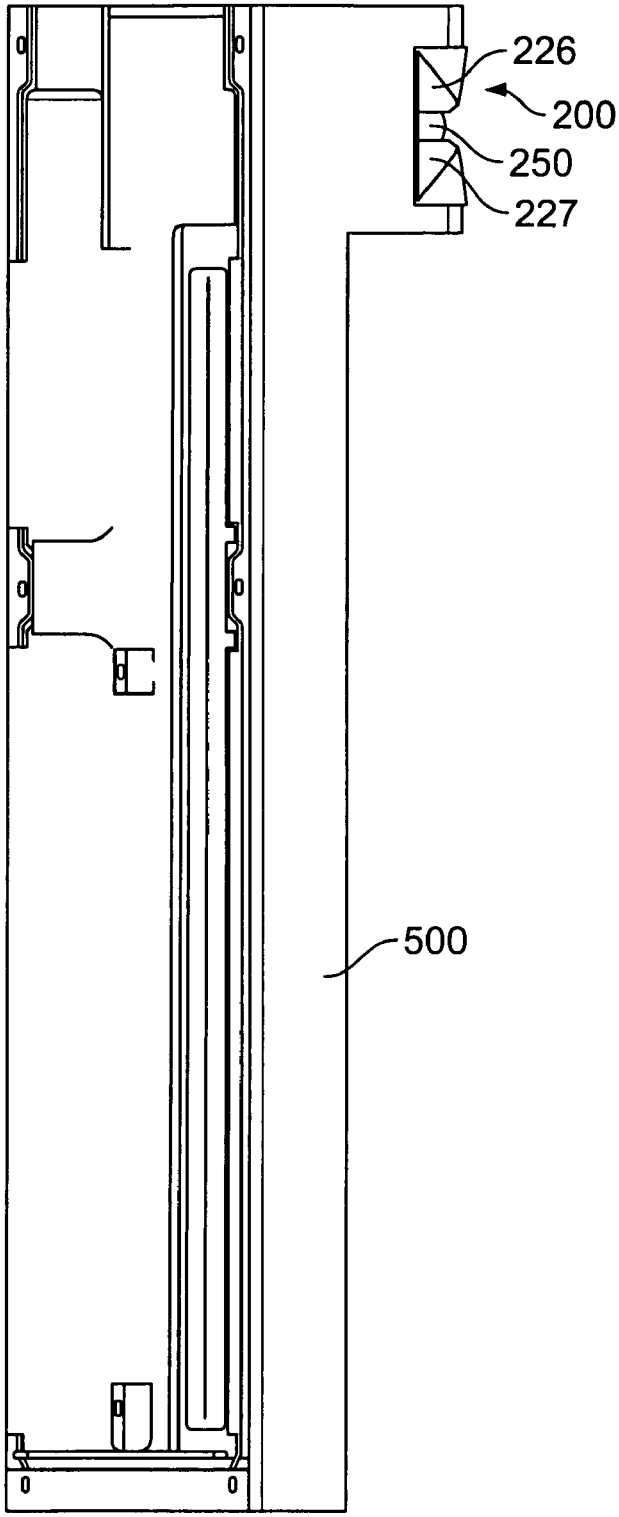
FIG. 6 shows a side view of a portion of an electronic device and an LED guard according to an embodiment of the present invention.

FIG. 6 shows a side view of a portion of an electronic housing 500 integrated with the guard 200. The electronic housing has been rotated away to demonstrate the expanded three-dimensional field of view provided by the guard 200. In FIG. 6, the gap 120 and walls 226 and 227 are visible. The LED 250 is also visible through the gap 120 despite the top surface of the base 210 facing slightly away in the figure.

As shown in FIG. 6, the guard 200 is a separate part and is integrated into a recess provided in the housing 500. The guard 200 may be affixed to the housing 500 using adhesive, may be welded to the housing 500 or may be attached to the housing 500 using some other connecting means such as, for example, rivets, screws, bolts or other known fasteners. Alternatively, the guard 200 may be integral to the housing 500 such that the gaps 100, 110, and 120 and the walls 225, 226, 227, and 228 may be machined from the housing 500 according to manufacturing processes well known in the art.

Figure 7:
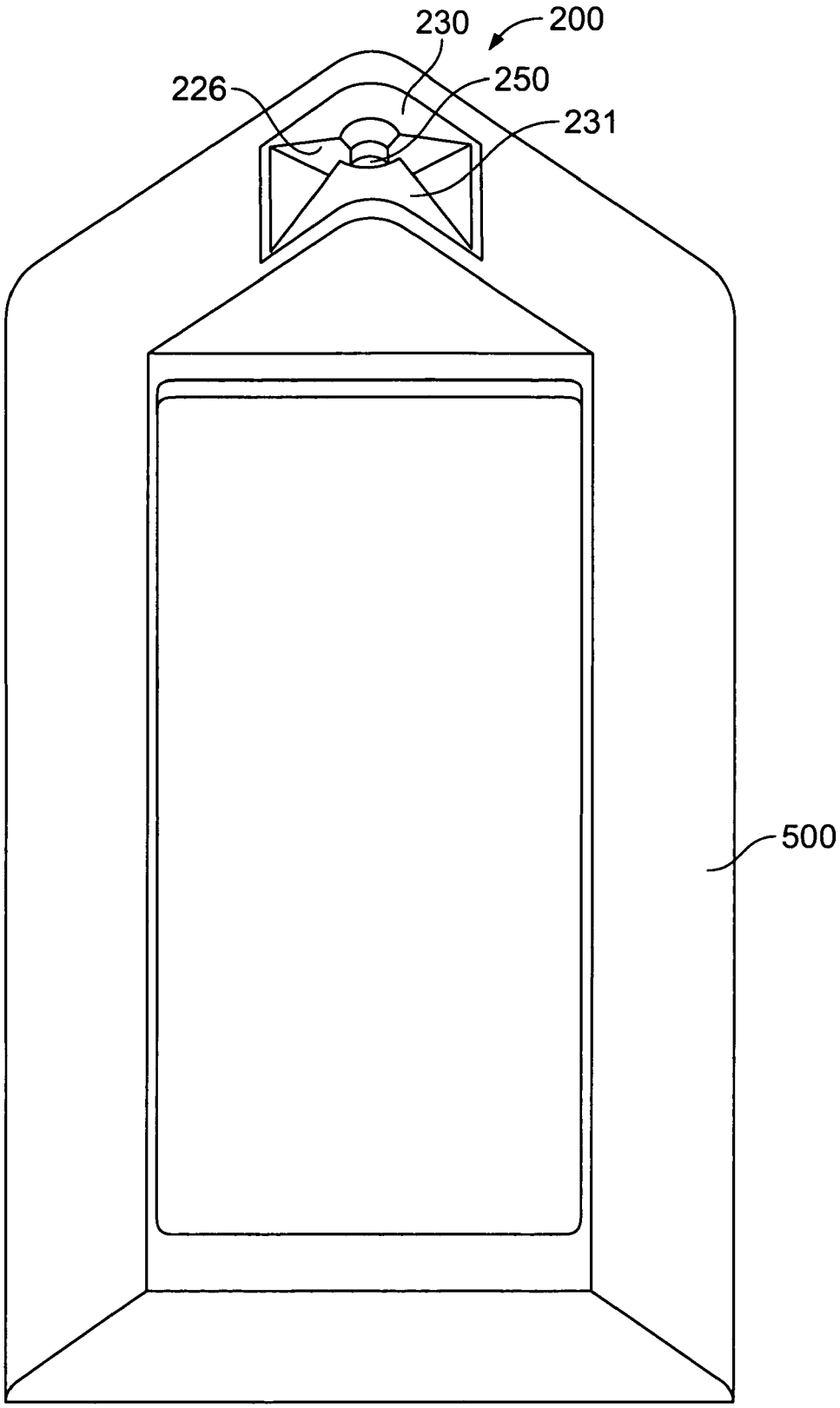
FIG. 7 shows a front view of a portion of an electronic device and an LED guard according to an embodiment of the present invention.

FIG. 7 shows a front view of a portion of an electronic housing 500 integrated with the guard 200. The electronic housing has been rotated upward to demonstrate the expanded three-dimensional field of view provided by the guard 200. In FIG. 7, the gap 110 is visible along with the beveled edge 232. Although the beveled edge 233 is not visible in the figure, a portion of the LED 250 is still within the field of view 270.

Figure 8:
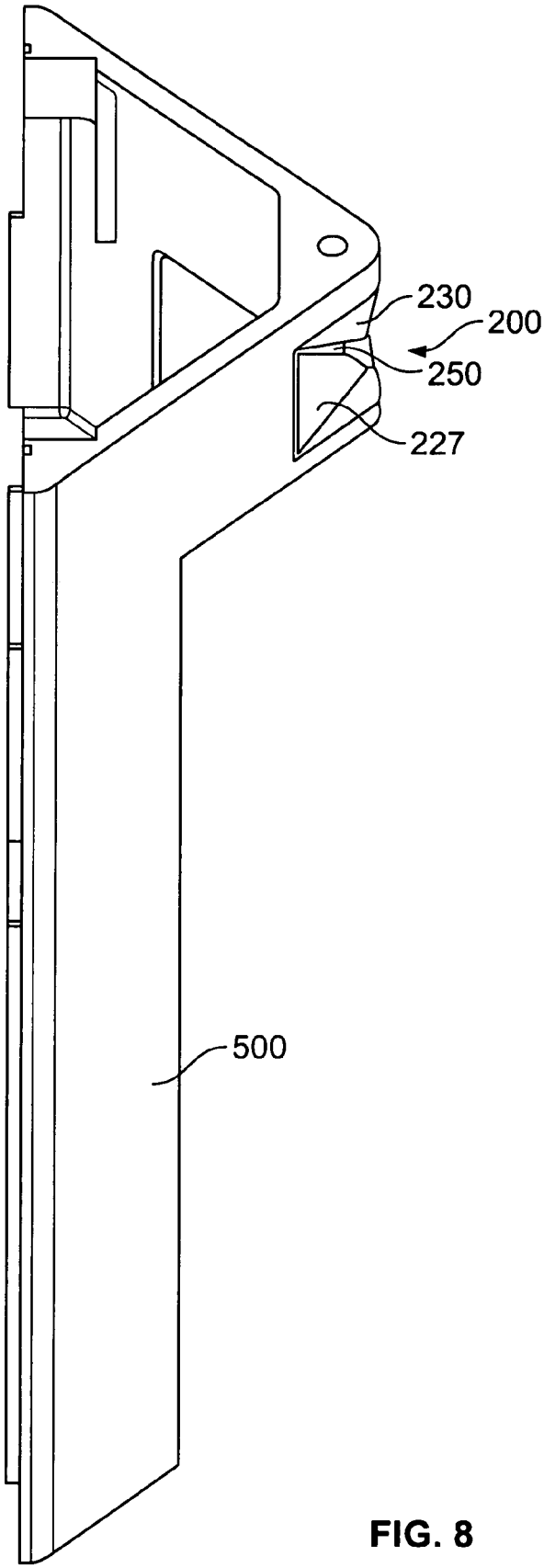
FIG. 8 shows a side view of a portion of an electronic device and an LED guard according to an embodiment of the present invention.

FIG. 8 shows a side view of a portion of an electronic housing 500 integrated with the guard 200. The electronic housing has been rotated downward to demonstrate the expanded three-dimensional field of view provided by the guard 200. In FIG. 8, the gap 120 is visible along with the wall 227. The LED 250 is also visible in FIG. 8 and demonstrates the outer limits of the field of view 260 as described in FIG. 4. The view shown in FIG. 8 is representative a view along the line of sight 262 in FIG. 4.

FIGS. 6-8 show the guard 200 positioned on the corner of an electronic housing 500. The position of the guard 200 on the corner provides for a greater overall field of view due to the reduction of the base 210. However, it will be obvious to one skilled in the art that it is not necessary to position the guard 200 on a corner to practice the present invention.

The electric housing 500 in FIGS. 6-8 also show how the guard 200 protects the LED 250 from damage during use and accidental falls. Handheld devices are prone to being dropped during use and the guard 200 as shown in FIG. 8, provides an embedded LED 250 that is protected from contact with the ground if dropped. This characteristic of the guard 200 may be especially advantageous when working in difficult environments or where there are few flat secure surfaces to place electronic equipment while working.

The guard 200 may be fabricated from any number of materials and produced in a number of different sizes. Electronic housings are often fabricated from molded plastic or metal, however, the guard 200 and the electrical housing 500 may be fabricated using known manufacturing processes from materials such as plastic, wood, metal and composite. The guard 200 may also be scaled up or down depending on the application and the size of the LED 250. The guard 200 may also be sized to avoid a particular size of particulate or object capable of damaging the LED 250.

Although the present invention has been described with reference to LED displays, the present invention is intended to be used with other light emitting elements or devices. It should be obvious to one skilled in the art that use of the LED 250 in the above discussion may be replaced with other lighting means without deviating from the scope and spirit of the present invention.

Numerous other configurations of an LED guard may be implemented based on the present disclosure. While the invention has been described with reference to specific preferred embodiments, it is not limited to these embodiments. The invention may be modified or varied in many ways and such modifications and variations, as would be obvious to one of skill in the art, are within the scope and spirit of the invention and are included within the scope of the following claims.

What is claimed is:

1. A guard configured to protect a lighting means, the lighting means having a top surface and at least one side surface; the guard comprising:

a first element having a first top surface, a first wall, and a second wall;

a second element having a second top surface, a third wall, and a fourth wall;

the first wall and the third wall are angularly disposed at substantially ninety degrees, and the second wall and the fourth wall are angularly disposed at substantially ninety degrees;

wherein the lighting means is disposed between the first element and the second element such that the top surface of the lighting means is below the first top surface and the second top surface;

the first wall and the third wall define a first gap, the first gap configured to provide a first field of view including at least a first substantially orthogonal line of sight to the at least one side surface of the lighting means; and the second wall and the fourth wall define a second gap, the second gap configured to provide a second field of view including a second substantially orthogonal line of sight to the at least one side surface of the lighting means.

2. The guard of claim 1, further comprising the first element being out of direct contact with said second element.

3. The guard of claim 1, wherein said first and second elements and said first and second gaps completely encircle the lighting means.

4. A housing for an electronic device configured to protect a lighting means, the lighting means having a top surface and at least one side surface, the housing comprising:

a body portion;

a guard including:

a first element having a first top surface and a first wall;

a second element having a second top surface and a second wall angularly disposed to the first wall by an angle of approximately ninety degrees;

wherein the lighting means is positionable substantially between the first element and the second element such that the top surface of the lighting means is below the first top surface and the second top surface, and the first element and the second element substantially define at least a first gap, the at least first gap providing a first field of view including at least one first substantially orthogonal line of sight to the at least one side surface of the lighting means; wherein the first element further comprises a third wall and the second element further comprises a fourth wall angularly disposed to the third wall, the third wall and the fourth wall substantially defining a at least second gap between the first element and the second element;

wherein the at least second gap is configured to provide a second field of view including at least one second substantially orthogonal line of sight to the at least one side of the lighting means; and said first element being out of direct contact with said second element.

5. The housing according to claim 4, wherein the first wall and the second wall substantially define the at least first gap between the first element and the second element.

6. The housing according to claim 5, wherein the at least second gap is substantially opposite the at least first gap.

7. The housing according to claim 5, wherein the first element further comprises a fifth wall and the second element further comprises a sixth wall, the fifth wall and the sixth wall substantially conform to the lighting means and define at least a third gap between the first element and the second element.

8. The housing according to claim 7, wherein the at least third gap is configured to provide a third field of view, the third field of view including at least on third line of sight to the top surface of the lighting means.

9. The guard of claim 5, wherein said first and second elements and said first and second gaps completely encircle the lighting means.

10. The housing according to claim 4, wherein the body and the guard are integrally formed.

11. The housing according to claim 4 wherein the body includes at least one corner and the guard is located on the corner.

* * * * *